US008918018B2

(12) United States Patent
Wei et al.

(10) Patent No.: US 8,918,018 B2
(45) Date of Patent: Dec. 23, 2014

(54) IMAGE FORMING APPARATUS HAVING REGULATING MECHANISM FOR POSITIONING EXPOSURE MECHANISM

(71) Applicants: Zhang Wei, Nagoya (JP); Atsushi Hayakawa, Okazaki (JP)

(72) Inventors: Zhang Wei, Nagoya (JP); Atsushi Hayakawa, Okazaki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 66 days.

(21) Appl. No.: 13/849,827

(22) Filed: Mar. 25, 2013

(65) Prior Publication Data

US 2013/0322919 A1 Dec. 5, 2013

(30) Foreign Application Priority Data

May 30, 2012 (JP) ..... 2012/122561

(51) Int. Cl.
*G03G 15/00* (2006.01)
*G03G 21/16* (2006.01)
*G03G 21/18* (2006.01)

(52) U.S. Cl.
CPC ..... *G03G 21/18* (2013.01); *G03G 21/1666* (2013.01); *G03G 21/1685* (2013.01); *G03G 2221/169* (2013.01); *G03G 21/1619* (2013.01)
USPC ..... 399/118; 399/111

(58) Field of Classification Search
USPC ..... 399/111, 118
See application file for complete search history.

(56) References Cited

U.S. PATENT DOCUMENTS

| | | | | |
|---|---|---|---|---|
| 6,545,693 | B2 * | 4/2003 | Kitayama et al. | 347/138 |
| 7,825,946 | B2 | 11/2010 | Sugiyama et al. | |
| 7,840,159 | B2 | 11/2010 | Nakashima | |
| 7,957,666 | B2 * | 6/2011 | Sato et al. | 399/107 |
| 7,962,061 | B2 * | 6/2011 | Sato et al. | 399/107 |
| 7,982,761 | B2 | 7/2011 | Yokoi | |
| 7,983,596 | B2 * | 7/2011 | Hagiwara et al. | 399/110 |
| 8,040,368 | B2 | 10/2011 | Yokoi | |
| 8,068,762 | B2 | 11/2011 | Yamaguchi | |
| 8,170,447 | B2 * | 5/2012 | Kubo et al. | 399/118 |
| 8,238,764 | B2 | 8/2012 | Funahashi | |
| 8,364,059 | B2 | 1/2013 | Kato | |
| 8,698,860 | B2 * | 4/2014 | Sugiyama et al. | 347/138 |
| 8,717,398 | B2 * | 5/2014 | Yokoi et al. | 347/242 |
| 2008/0292359 | A1 | 11/2008 | Yamaguchi | |
| 2009/0087209 | A1 * | 4/2009 | Yamaguchi | 399/98 |
| 2009/0087210 | A1 * | 4/2009 | Terao et al. | 399/99 |

(Continued)

FOREIGN PATENT DOCUMENTS

| | | |
|---|---|---|
| JP | 03-198067 A | 8/1991 |
| JP | 08-189518 A | 7/1996 |

(Continued)

*Primary Examiner* — David Bolduc
(74) *Attorney, Agent, or Firm* — Banner & Witcoff, Ltd.

(57) ABSTRACT

There is provided an image forming apparatus including a main apparatus body, a photoconductor, an exposure mechanism, a frame, and a regulating mechanism. The regulating mechanism includes a fixing member, a movable member, and a biasing member. The frame includes a first contacting surface. The exposure mechanism includes second and third contacting surfaces, and the fixing member includes a fourth contacting surface, first and second facing surfaces. The movable member includes third and fourth facing surfaces. When the exposure mechanism is disposed at the approach position, the biasing member allows the second and third facing surfaces to make a contact with the second and third contacting surfaces, respectively. When the exposure mechanism is disposed at the separation position, the biasing member allows the first and fourth facing surfaces to make a contact with the first and fourth contacting surfaces, respectively.

9 Claims, 14 Drawing Sheets

(56) References Cited

U.S. PATENT DOCUMENTS

| | | | | |
|---|---|---|---|---|
| 2009/0116875 | A1 | 5/2009 | Sugiyama et al. | |
| 2009/0162091 | A1 | 6/2009 | Yokoi | |
| 2009/0169260 | A1 | 7/2009 | Yokoi | |
| 2009/0169261 | A1 | 7/2009 | Yokoi | |
| 2009/0202272 | A1 | 8/2009 | Nakashima | |
| 2009/0220250 | A1 | 9/2009 | Funahashi | |
| 2009/0274488 | A1 | 11/2009 | Sugiyama | |
| 2009/0322850 | A1 | 12/2009 | Tamaru et al. | |
| 2010/0020155 | A1 | 1/2010 | Tamaru et al. | |
| 2010/0021200 | A1 | 1/2010 | Kato | |
| 2010/0054813 | A1 | 3/2010 | Tamaru et al. | |
| 2011/0255905 | A1 | 10/2011 | Yokoi | |
| 2013/0136496 | A1* | 5/2013 | Kato | 399/117 |
| 2013/0259521 | A1* | 10/2013 | Sugiyama | 399/110 |

FOREIGN PATENT DOCUMENTS

| | | | |
|---|---|---|---|
| JP | 2001-130047 | A | 5/2001 |
| JP | 2007-069528 | A | 3/2007 |
| JP | 2007-271734 | A | 10/2007 |
| JP | 2008-275819 | A | 11/2008 |
| JP | 2008-304631 | A | 12/2008 |
| JP | 2009-014983 | A | 1/2009 |
| JP | 2009-086507 | A | 4/2009 |
| JP | 2009-154413 | A | 7/2009 |
| JP | 2009-157001 | A | 7/2009 |
| JP | 2009-157142 | A | 7/2009 |
| JP | 2009-192624 | A | 8/2009 |
| JP | 2009-205056 | A | 9/2009 |
| JP | 2009-210613 | A | 9/2009 |
| JP | 2010-008913 | A | 1/2010 |
| JP | 2010-008930 | A | 1/2010 |
| JP | 2010-032576 | A | 2/2010 |
| JP | 2010-032649 | A | 2/2010 |
| JP | 2010-052153 | A | 3/2010 |
| JP | 2010-052154 | A | 3/2010 |
| JP | 2011-016364 | A | 1/2011 |

* cited by examiner

IMAGE FORMING APPARATUS HAVING REGULATING MECHANISM FOR POSITIONING EXPOSURE MECHANISM

CROSS REFERENCE TO RELATED APPLICATION

The present application claims priority from Japanese Patent Application No. 2012-122561, filed on May 30, 2012, the disclosure of which is incorporated herein by reference in its entirety.

BACKGROUND OF THE INVENTION

1. Field of the Invention

The present invention relates to an image forming apparatus.

2. Description of the Related Art

A conventional image forming apparatus is provided with a main apparatus body, a photoconductor, an exposure mechanism, a frame, and a regulating mechanism.

The photoconductor is held or retained by the main apparatus body. The photoconductor is configured to carry a toner image, and the photoconductor transfers the toner image to a sheet transported in the main apparatus body.

The exposure mechanism is supported by the main apparatus body so that the exposure mechanism is displaceable to an approach position at which the exposure mechanism approaches the photoconductor and a separation position at which the exposure mechanism is separated from the photoconductor. At the approach position, the exposure mechanism forms, on the photoconductor, a latent image for allowing the photoconductor to carry the toner image.

The frame is provided on the main apparatus body so that the frame is positioned on one end side of the photoconductor in the widthwise direction parallel to the axial center of the photoconductor.

The regulating mechanism is provided on the frame. The regulating mechanism positions the exposure mechanism disposed at the approach position in the positioning direction which is perpendicular to the widthwise direction and which intersects the approaching/separating direction in which the exposure mechanism is displaced between the approach position and the separation position.

The regulating mechanism has, for example, a first contacting member, a first contacting member support portion, a second contacting member, a third contacting member, a third contacting member support portion, and an biasing spring.

The first contacting member is a roller which makes a contact with the exposure mechanism disposed at the approach position, from one end side in the positioning direction. The first contacting member support portion is a portion which is provided on the frame and which rotatably supports the first contacting member. The second contacting member is a portion which is provided on the frame and which makes a contact with the exposure mechanism disposed at the approach position from one end side in the positioning direction. The third contacting member is a roller which makes a contact with the exposure mechanism disposed at the approach position from the other end side in the positioning direction. The third contacting member support portion is an arm which is provided swingably on the frame and which rotatably supports the third contacting member. The biasing spring is provided between the frame and the third contacting member support portion, and the biasing spring biases the third contacting member toward the first contacting member and the second contacting member.

In this image forming apparatus, the regulating mechanism positions the exposure mechanism disposed at the approach position in the positioning direction as follows. That is, the first contacting member and the third contacting member make a contact with the exposure mechanism displaced to the approach position from one end side and the other end side in the positioning direction while being rotated so that the exposure mechanism is guided to the approach position. Further, the biasing spring biases and pushes the exposure mechanism disposed at the approach position with respect to the first contacting member and the second contacting member by the aid of the third contacting member support portion and the third contacting member. Accordingly, the exposure mechanism is positioned in the positioning direction. As a result, the exposure mechanism can form the latent image on the photoconductor without causing any positional deviation.

SUMMARY OF THE INVENTION

However, in the case of the conventional image forming apparatus described above, the regulating mechanism has, for example, the first contacting member, the first contacting member support portion, the second contacting member, the third contacting member, the third contacting member support portion, and the biasing spring. Therefore, the number of parts is large, and it is difficult to simplify the assembling operation. As a result, it is difficult for such an image forming apparatus to realize inexpensive production cost.

The present teaching has been made taking the foregoing actual circumstances of the conventional technique into consideration, an object of which is to provide an image forming apparatus which makes it possible to realize inexpensive production cost.

According to an aspect of the present teaching, there is provided an image forming apparatus configured to form an image on a sheet including:

a main apparatus body;

a photoconductor which is held by the main apparatus body, which is configured to carry a toner image, and which is configured to transfer the toner image to the sheet transported in the main apparatus body;

an exposure mechanism supported by the main apparatus body displaceably to an approach position at which the exposure mechanism approaches the photoconductor and a separation position at which the exposure mechanism is separated from the photoconductor and which is configured so that a latent image is formed on the photoconductor at the approach position to allow the photoconductor to carry the toner image;

a frame which is provided on the main apparatus body so that the frame is positioned on one end side of the photoconductor in a widthwise direction thereof that is parallel to an axial center of the photoconductor; and a regulating mechanism which is provided on the frame and which is configured so that the exposure mechanism disposed at the approach position is positioned in a positioning direction which is perpendicular to the widthwise direction and which intersects an approaching/separating direction in which the exposure mechanism is displaced between the approach position and the separation position, wherein the regulating mechanism includes a fixing member which is supported by the frame displaceably in the positioning direction, a movable member which is supported by the fixing member displaceably in the positioning direction, and an biasing member which is provided between the frame and the movable member;

the frame includes a first contacting surface which is directed to one side in the positioning direction;

the exposure mechanism includes a second contacting surface which is directed to the other side in the positioning direction at the approach position, and a third contacting surface which is directed to one side in the positioning direction at the approach position;

the fixing member includes a fourth contacting surface which is directed to one side in the positioning direction, a first facing surface which faces the first contacting surface from one side in the positioning direction, and a second facing surface which faces the second contacting surface from the other side in the positioning direction under a condition that the exposure mechanism is disposed at the approach position;

the movable member includes a third facing surface which faces the third contacting surface from one side in the positioning direction under a condition that the exposure mechanism is disposed at the approach position, and a fourth facing surface which faces the fourth contacting surface from one side in the positioning direction under a condition that the exposure mechanism is disposed at the separation position; and the biasing member biases the movable member from one side in the positioning direction to the other side in the positioning direction, the biasing member including such a biasing force that the third facing surface is allowed to make a contact with the third contacting surface, the second facing surface is allowed to make a contact with the second contacting surface, and the first facing surface is allowed to make a contact with the first contacting surface under a condition that the exposure mechanism is disposed at the approach position, while the fourth facing surface is allowed to make a contact with the fourth contacting surface, and the first facing surface is allowed to make a contact with the first contacting surface under a condition that the exposure mechanism is disposed at the separation position.

In the image forming apparatus of the present teaching, the regulating mechanism positions the exposure mechanism disposed at the approach position in the positioning direction as follows.

That is, when the exposure mechanism is disposed at the approach position, the biasing member biases the movable member in the direction directed from one side in the positioning direction to the other side in the positioning direction. Accordingly, the third facing surface of the movable member makes a contact with the third contacting surface of the exposure mechanism, the second facing surface of the fixing member makes a contact with the second contacting surface of the exposure mechanism, and the first facing surface of the fixing member makes a contact with the first contacting surface of the frame. In other words, when the exposure mechanism is disposed at the approach position, the exposure mechanism, which is biased by the biasing member by the aid of the movable member, makes a contact with the frame and stops by the aid of the fixing member. Therefore, the exposure mechanism is positioned with respect to the frame together with the fixing member.

On the other hand, when the exposure mechanism is disposed at the separation position, the biasing member biases the movable member in the direction directed from one side in the positioning direction to the other side in the positioning direction. Accordingly, the fourth facing surface of the movable member makes a contact with the fourth contacting surface of the fixing member, and the first facing surface of the fixing member makes a contact with the first contacting surface of the frame. In other words, when the exposure mechanism is disposed at the separation position, the fixing member, which is biased by the biasing member by the aid of the movable member, makes a contact with the frame and stops. Therefore, the fixing member is positioned with respect to the frame.

In this way, the regulating mechanism positions the exposure mechanism in the positioning direction by means of the simple construction having the fixing member, the movable member, and the biasing member. Further, the fixing member is always positioned with respect to the frame irrelevant to whether the exposure mechanism is disposed at the approach position or the separation position. Therefore, in the case of this image forming apparatus, it is unnecessary to provide any joining mechanism such as any screw or the like for fixing the fixing member to the frame. As a result, in the case of this image forming apparatus, it is possible to realize the reduction of the number of parts and the simplification of the assembling operation in relation to the regulating mechanism.

Therefore, the image forming apparatus of the present teaching makes it possible to realize the inexpensive production cost. Further, in the case of this image forming apparatus, the number of parts of the regulating mechanism is reduced as compared with the conventional image forming apparatus described above, and thus the installation space for the regulating mechanism can be decreased. Therefore, it is possible to realize the small size.

DESCRIPTION OF THE PREFERRED EMBODIMENTS

An explanation will be made below with reference to the drawings about an embodiment in which the present teaching is embodied.

Figure 1:
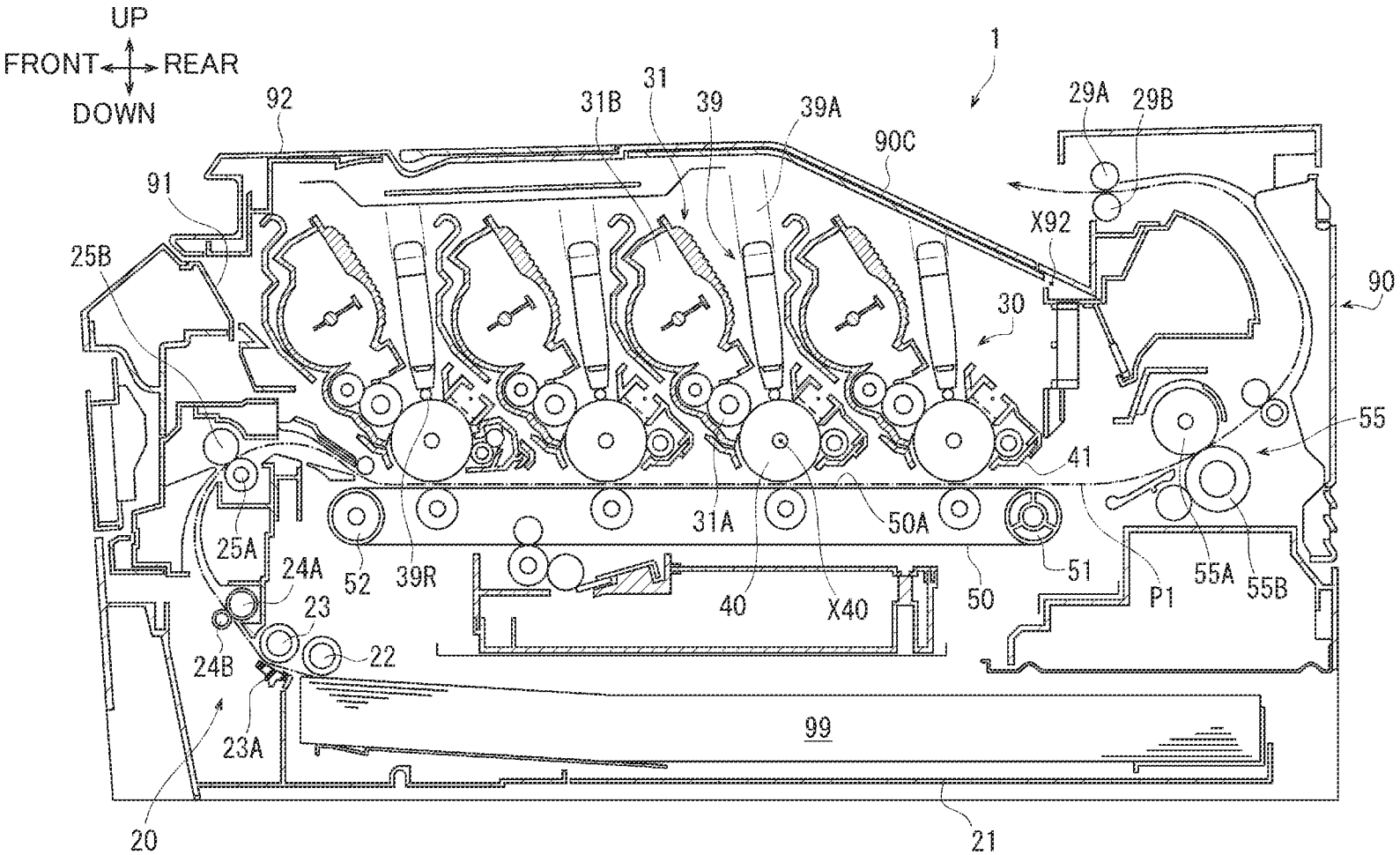
FIG. 1 shows a schematic sectional view illustrating an image forming apparatus according to an embodiment.

As shown in FIG. 1, an image forming apparatus 1 of the embodiment is a color laser printer in which an image of a plurality of colors is formed on a sheet 99 which is, for example, the printing paper or OHP sheet, in accordance with the electrophotographic system. In FIG. 1, the left side of the paper surface is defined as the front side of the apparatus, and the front side of the paper surface, which is the side disposed on the right when the apparatus is viewed from the front side, is defined as the right side so as to indicate the respective directions of the forward and rearward, the left and right, and the up and down. Further, all of the respective directions shown in FIG. 2 and the followings are expressed while corresponding to the respective directions shown in FIG. 1. An explanation will be made below on the basis of FIG. 1 and so forth about the respective constitutive components provided for the image forming apparatus 1.

<Overall Arrangement>

As shown in FIG. 1, the image forming apparatus 1 includes a substantially box-shaped housing 90. Further, the image forming apparatus 1 includes a frame member such as a frame 200 or the like shown in FIG. 2 in the housing 90. The frame 200 is a flat plate member made of metal extending in the front-back direction and the upward-downward direction along the left side surface of the housing 90. The frame 200 is positioned on the deep side in relation to the paper surface as viewed in FIG. 1. An unillustrated frame, which forms a pair with the frame 200 in the left-right direction, is provided in the housing 90. This frame has the same or equivalent shape as that of the frame 200, and it extends along the right side surface of the housing 90. A main apparatus body of the present teaching is constructed by the housing 90 and the frame member such as the frame 200 and the like.

Figure 3:
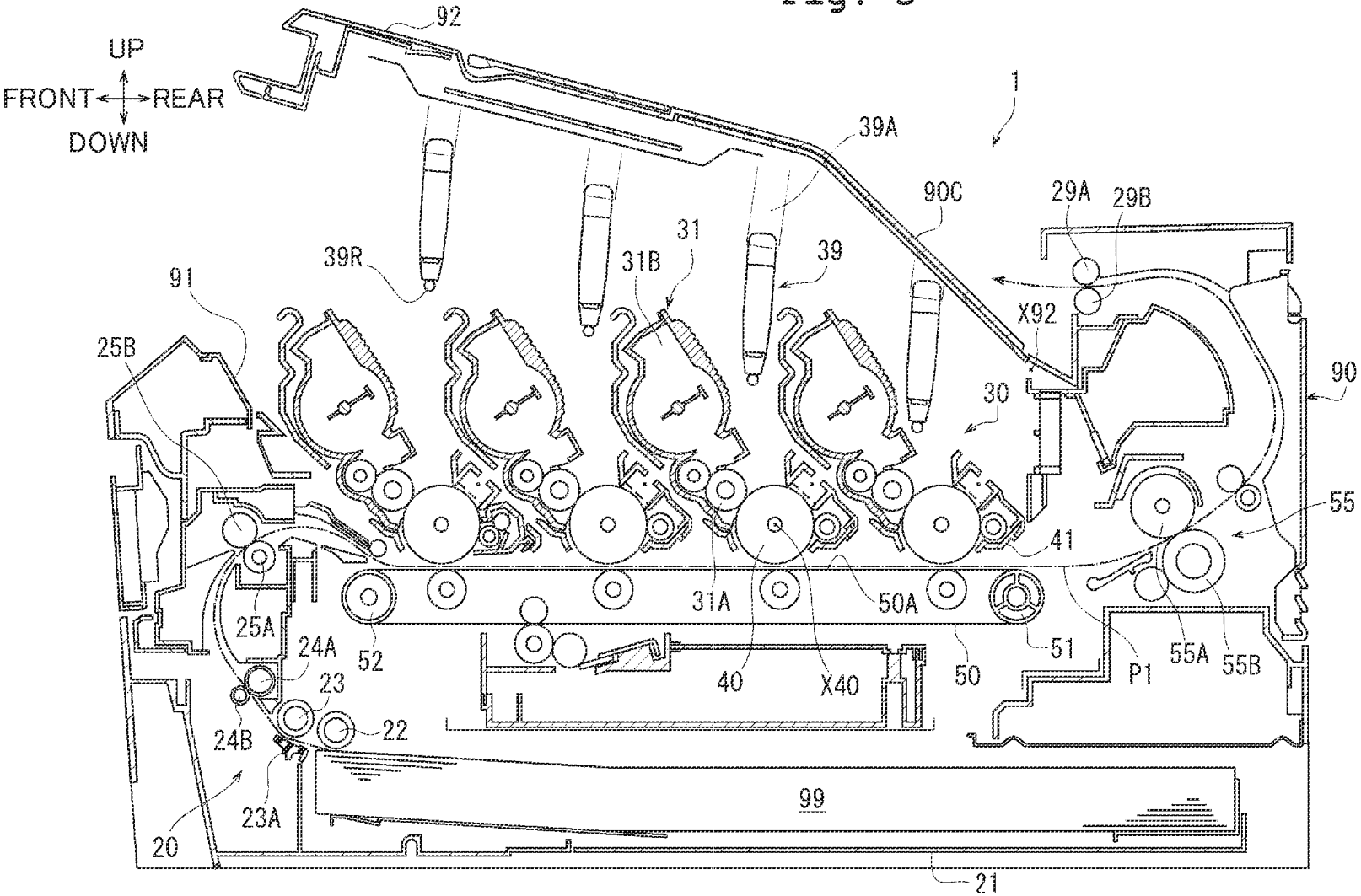
FIG. 3 shows a schematic sectional view illustrating the image forming apparatus to depict a state in which an exposure mechanism is disposed at the separation position.

As shown in FIGS. 1 and 3, the housing 90 has an opening 91 which communicates the space over the housing 90 and the inside of the housing 90, and an upper surface cover 92 which closes the opening 91. The upper surface cover 92 is supported by the housing 90 swingably about the opening/closing axial center 92 provided at the upper end edge on the back surface side of the housing 90. Accordingly, the upper surface cover 92 makes the swinging movement about the opening/closing axial center 92, from the state shown in FIG. 1, and the front end edge side of the upper surface cover 92 is displaced upwardly and backwardly as shown in FIG. 3. In this situation, the opening 91 is opened by means of the upper surface cover 92. A discharge tray 90C, which is inclined downwardly toward the back side, is provided on the upper surface of the upper surface cover 92.

The posture or attitude of the swinging movement of the upper surface cover 92 shown in FIG. 3 is referred to by way of example. Although not shown, the upper surface cover 92 can further perform the swinging movement to a great extent from the posture of the swinging movement shown in FIG. 3. In this situation, the opening 91 is opened to a greater extent as compared with the state shown in FIG. 3.

As shown in FIG. 1, a sheet cassette 21 is detachably provided at a lower portion at the inside of the housing 90. The sheet cassette 21 is constructed so that the upper portion can be opened. The sheet cassette 21 has a box-shaped form, and a plurality of stacked sheets 99 are accommodated therein.

A transport route P1 is defined in the housing 90. The transport route P1 is the following route. That is, the transport route P1 travels from the front end portion of the sheet cassette 21 toward the front surface side of the housing 90, and then the transport route P1 turns upwardly in a U-shaped form to change the direction backwardly. Subsequently, the transport route P1 travels horizontally toward the back surface side of the housing 90, and then the transport route P1 turns upwardly in a U-shaped form. Further, the transport route P1 travels frontwardly to arrive at the discharge tray 90C.

The image forming apparatus 1 is provided with a paper feed unit 20, an image forming unit 30, and a pair of discharge rollers 29A, 29B. The paper feed unit 20, the image forming unit 30, and the pair of discharge rollers 29A, 29B are positioned over or above the sheet cassette 21 between the frame 200 and the unillustrated frame which forms the pair with the frame 200 in the left-right direction in the housing 90.

In the paper feed unit 20, the sheet 99, which is accommodated in the sheet cassette 21, is fed one by one to the transport route P1 by means of a paper feed roller 22, a separation roller 23, and a separation pad 23A. The sheet 99 is transported to the image forming unit 30 by means of a pair of transport rollers 24A, 24B and a pair of resist rollers 25A, 25B arranged at the U-turn portion in front of the transport route P1.

In the image forming unit 30, the so-called direct tandem system is adopted. The image forming unit 30 has, for example, a transfer belt 50 which is provided under the horizontal portion of the transport route P1, four sets of photosensitive drums 40, process cartridges 31, and LED heads for exposure 39 which are positioned over the transfer belt 50 with the horizontal portion of the transport route P1 intervening therebetween, and a fixing device 55 which is positioned on the lower side of the U-turn portion disposed at the back of the transport route P1. The photosensitive drum 40 is an example of the "photoconductor" of the present teaching. The LED head for exposure 39 is an example of the "exposure mechanism" of the present teaching.

The transfer belt 50 is an endless belt which circulates while being wound around a driving roller 51 which is rotatable about the rotational shaft directed in the left-right direction at the back portion in the housing 90 and a driven roller 52 which is rotatable about the rotational shaft parallel to the driving roller 51 at the front portion in the housing 90. The flat surface of the transfer belt 50, which extends in the left-right direction and the front-back direction along the horizontal portion of the transport route P1 between the driving roller 51 and the driven roller 52, is a transfer surface 50A. The sheet 99, which enters the horizontal portion of the transport route P1 while being transported by the paper feed unit 20, is transported to the circulating transfer belt 50 in a state of being adsorbed by the transfer surface 50A. Accordingly, the sheet 99 passes under the four sets of the photosensitive drums 40, the process cartridges 31, and the LED heads for exposure 39.

The four sets of the photosensitive drums 40, the process cartridges 31, and the LED heads for exposure 39 correspond to the four color toners of black, yellow, magenta, and cyan respectively.

Each of the photosensitive drums 40 is a cylindrical member having the axial center X40 extending in the left-right direction. The photosensitive drum 40 is provided opposingly from the upper position with respect to the transfer surface 50A with the horizontal portion of the transport route P1 intervening therebetween. The respective photosensitive drums 40 are aligned in the front-back direction along the horizontal portion of the transport route P1. The left-right direction, which is parallel to the axial center X40 of the photosensitive drum 40, is an example of the "widthwise direction" of the present teaching. Each of the photosensitive drums 40 is held by the frame 200 on the left end side of itself by the aid of a frame-shaped photoconductor holding unit 11. Further, each of the photosensitive drums 40 is held on the right end side of itself by the unillustrated frame which forms the pair with the frame 200 in the left-right direction.

Each of the process cartridges 31 is positioned obliquely upwardly in front of each of the photosensitive drums 40. The respective process cartridges 31 are aligned in the front-back direction along the horizontal portion of the transport route P1. Each of the process cartridges 31 has a substantially box-shaped form extending in the left-right direction. For example, a developing roller 31A, a toner accommodating unit 31B, and an unillustrated electrifier (charger) are arranged at the inside of each of the process cartridges 31. Each of the process cartridges 31 is detachably held by the photoconductor holding unit 41, and the developing roller 31A is allowed to make a contact with the photosensitive drum 40.

The respective LED heads for exposure 39 are positioned just over the respective photosensitive drums 40, and they are aligned in the front-back direction along the horizontal portion of the transport route P1. Each of the LED heads for exposure 39 has a plurality of LED elements which are arranged in a line form on a lower surface of a substantially plate-shaped member extending in the upward-downward direction and the left-right direction. The LED head for exposure 39 radiates the light in a line-shaped form having an exposure pattern based on the image data onto the surface of the photosensitive drum 40. Accordingly, the LED head for exposure 39 forms a latent image in order to allow the photosensitive drum 40 to carry a toner image.

Each of the LED heads for exposure 39 is assembled to the upper surface cover 92 by the aid of a support member 39A provided to extend in the upward-downward direction so that each of the LED heads for exposure 39 is integrally displaceable. In this context, the term "integrally displaceable" means that the term includes not only such a case that each of the LED heads for exposure 39 is simply fixed to the upper surface cover 92 but also such a case that each of the LED heads for exposure 39 is displaced together with the upper surface cover 92 while each of the LED heads for exposure 39 makes any relative displacement with respect to the upper surface cover 92 when the upper surface cover 92 makes swinging movement. In this embodiment, as shown in FIGS. 1 and 3, each of the LED heads for exposure 39 is assembled so that the relative displacement of each of the LED heads for exposure 39 is not caused with respect to the upper surface cover 92 when the upper surface cover 92 makes the swinging movement.

As shown in FIG. 1, when the upper surface cover 92 closes the opening 91, then the respective LED heads for exposure 39 approach the respective photosensitive drums 40 from the upper positions, and the lower surfaces of the respective LED heads for exposure 29 are opposed to the respective photosensitive drums 40 from the upper positions. On the other hand, as shown in FIG. 3, when the upper surface cover 92, opens the opening 91, the respective LED heads for exposure 39 are separated upwardly from the respective photosensitive drums 40.

The position of each of the LED heads for exposure 39 is designated as the approach position. The approach position is an example of the "approach position" of the present teaching. The position, at which each of the LED heads for exposure 39 is separated from the photosensitive drum 40 as exemplified by the position of each of the LED heads for exposure 39 as shown in FIG. 3 by way of example, is designated as "separation position". The separation position is an example of the "separation position" of the present teaching. When the respective LED heads for exposure 39 are displaced to the separation positions in the state in which the upper surface cover 92 opens the opening 91, the spaces are secured thereby around the respective process cartridges 31. The respective process cartridges 31 can be attached/detached with respect to the photoconductor holding unit 41 by utilizing the spaces.

In this embodiment, the upward-downward direction is the direction in which the LED head for exposure 39 is displaced between the approach position and the separation position. That is, the upward-downward direction is an example of the "approaching/separating direction" of the present teaching.

As shown in FIG. 1, a pair of left and right spacing distance holding rollers 39R are rotatably supported at both right and left ends of the lower surface of each of the LED heads for exposure 39. FIG. 1 shows the left spacing distance holding roller 39R. The right spacing distance holding roller 39R is positioned on the front side of the paper surface of FIG. 1. When the LED head for exposure 39 is disposed at the approach position, the both spacing distance holding rollers 39R are rotated while abutting against the left and right both ends of the photosensitive drum 40. Accordingly, the LED head for exposure 39, which is disposed at the approach position, is positioned in the upward-downward direction with respect to the photosensitive drum 40, and the spacing distance is maintained to be constant between the lower surface of each of the LED heads for exposure 39 and each of the photosensitive drums 40.

In this embodiment, the front-back direction is the direction which is perpendicular to the left-right direction parallel to the axial center X40 of each of the photosensitive drums 40 and which is perpendicular to the upward-downward direction in which the LED head for exposure 39 is displaced between the approach position and the separation position. That is, the front-back direction is an example of the "positioning direction" of the present teaching. Further, the back side is an example of "one side in the positioning direction" of the present teaching, and the front side is an example of "the other side in the positioning direction" of the present teaching.

Figure 2:
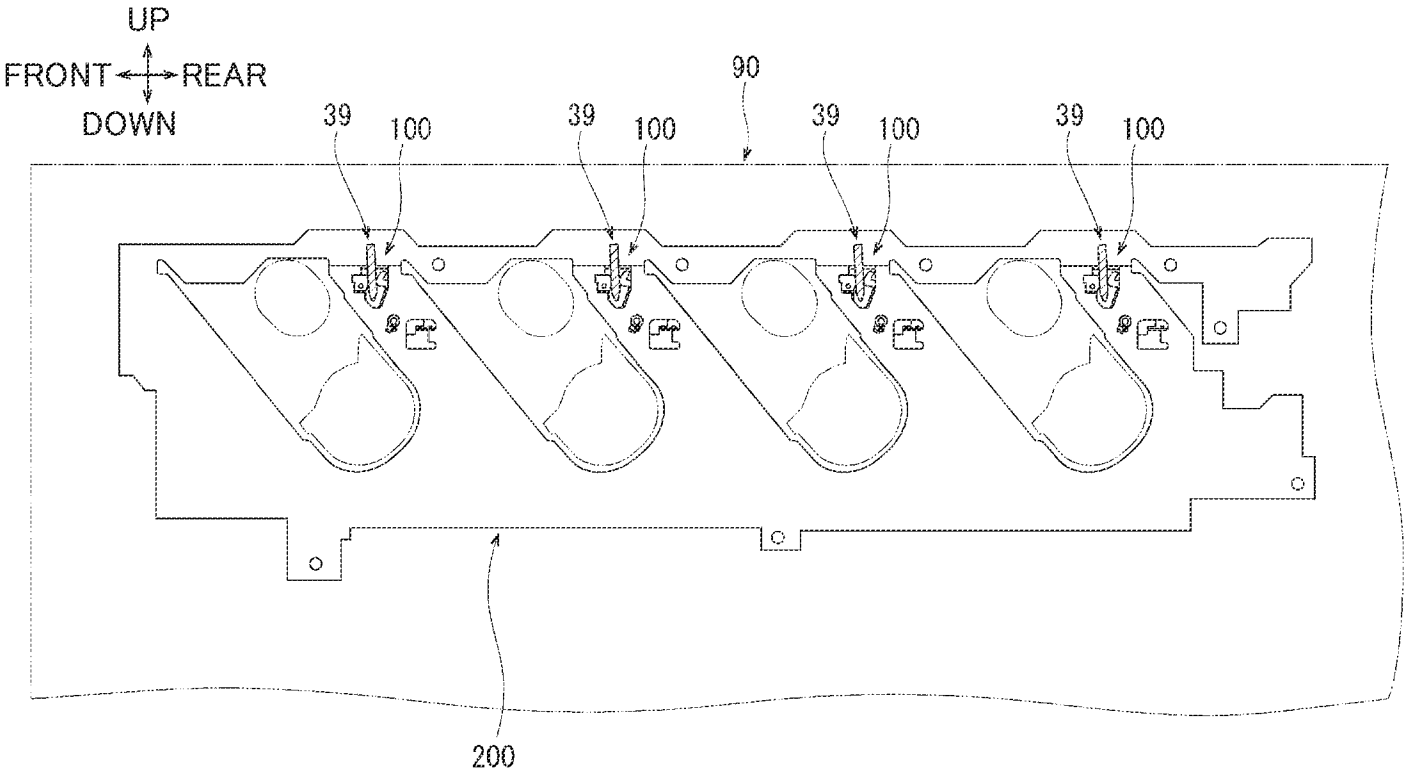
FIG. 2 shows a side view illustrating a frame and four regulating mechanisms.

As described in detail later on, as shown in FIG. 2, the image forming apparatus 1 is provided with, for example, four regulating mechanisms 100 corresponding to the respective LED heads for exposure 39. For example, the regulating mechanisms 100 position the respective LED heads for exposure 39 disposed at the approach positions.

The fixing device 55 has a heating roller 55A and a pressing roller 55B which are opposed to one another with the transport route P1 intervening therebetween.

The image forming unit 30 forms the image as follows on the sheet 99 transported along the transport route P1. That is, the surface of each of the photosensitive drums 40 is positively electrified uniformly by the electrifier or charger in accordance with the rotation thereof, and then the surface is exposed with the light in the line form radiated by each of the LED heads for exposure 39 disposed at the approach positions. Accordingly, each of the LED heads for exposure 39 forms the latent image corresponding to the image to be formed on the sheet 99, on the surface of each of the photosensitive drums 40. Subsequently, the toner of the color, which corresponds to the latent image formed on the surface of each of the photosensitive drums 40, is supplied from the toner accommodating unit 31B by means of the developing roller 31A of each of the process cartridges 31 to form the toner image on the surface of the photosensitive drum 40. The toner image is transferred to the sheet 99 such that the photosensitive drum 40 is rotated while making a contact with the sheet 99 transported along the horizontal portion of the transport route P1, and the negative voltage, which is applied to the transfer surface 50A, is allowed to act.

The fixing device 55 heats and presses the sheet 99 allowed to pass under the respective process cartridges 31 by means of the heating roller 55A and the pressing roller 55B to fix the toner images transferred to the sheet 99. After that, the sheet 99 is discharged to the discharge tray 90C by means of the pair of discharge rollers 29A, 29B. In this way, the image forming apparatus 1 completes the image forming action on the sheet 99.

<Regulating Mechanism>

As shown in FIG. 2, the four regulating mechanisms 100 are provided on the frame 200. Each of the regulating mechanisms 100 positions, in the front-back direction, the left end of each of the LED heads for exposure 39 disposed at the approach positions. The respective regulating mechanisms 100 are constructed identically, and they are aligned in the front-back direction. Therefore, the regulating mechanism 100 disposed at the most forward position will be explained in the following description and in the respective drawings of FIG. 4 and the followings. The other three regulating mechanisms 100 are omitted from the explanation and the illustration in the drawings. Distinct regulating mechanisms, each of which positions, in the front-back direction, the right end of each of the LED heads for exposure 39 disposed at the approach positions, are provided on the unillustrated frame which forms the pair in the left-right direction with the frame 200. These regulating mechanisms are constructed substantially identically with the regulating mechanism 100. Therefore, any explanation and any illustration in the drawings are omitted.

Figure 4:
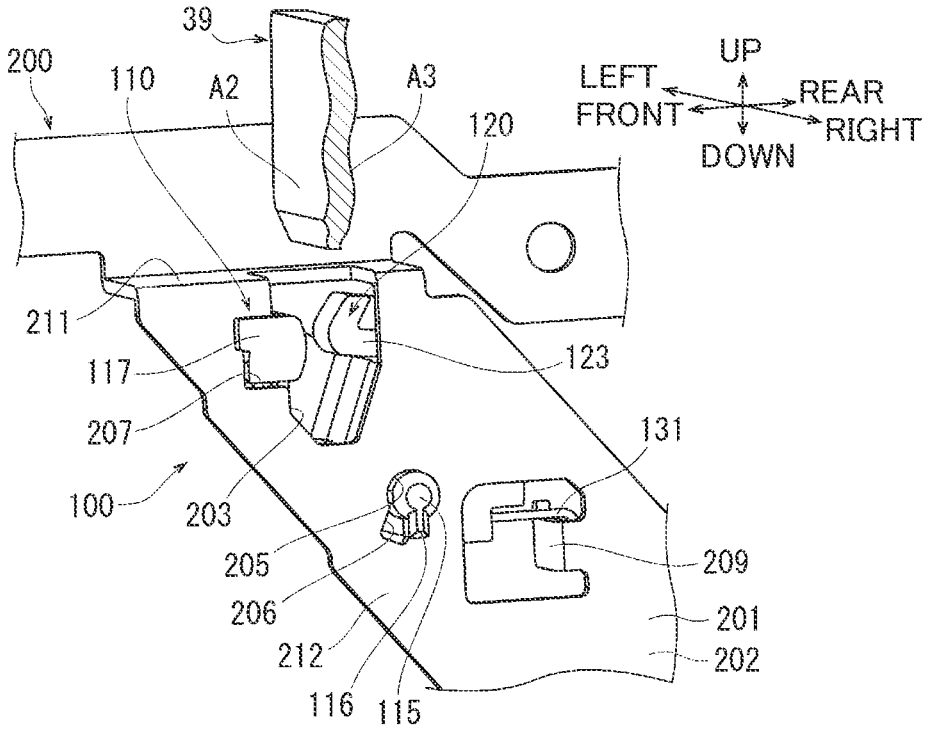
FIG. 4 shows a partial perspective view illustrating the frame and one regulating mechanism.
Figure 5:
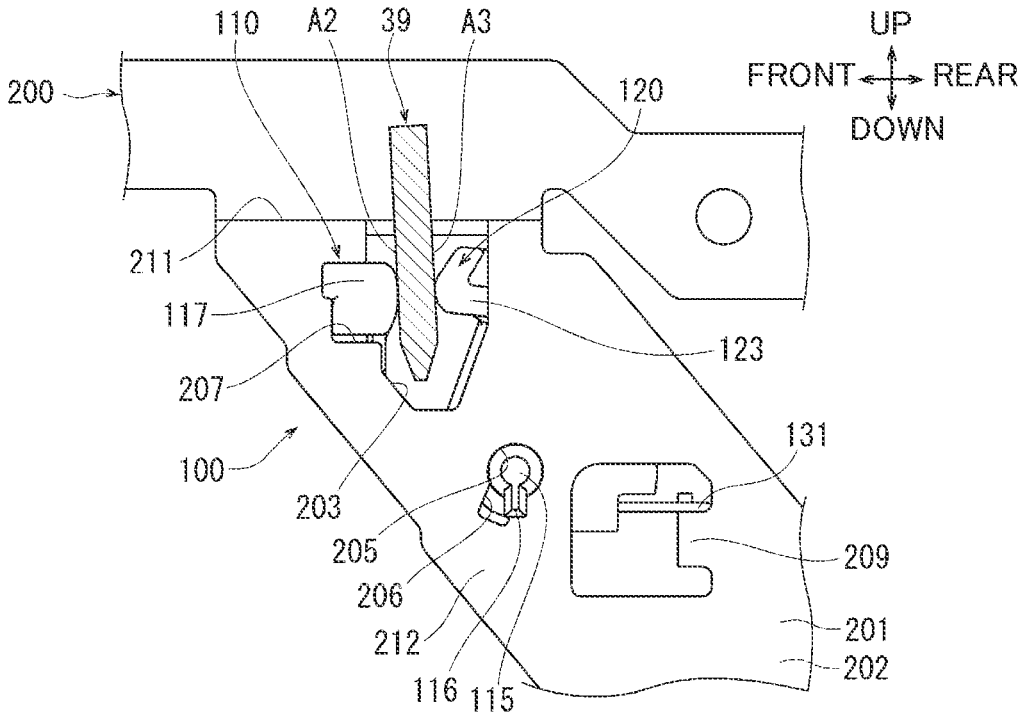
FIG. 5 shows a partial side view illustrating the frame and one regulating mechanism.
Figure 6:
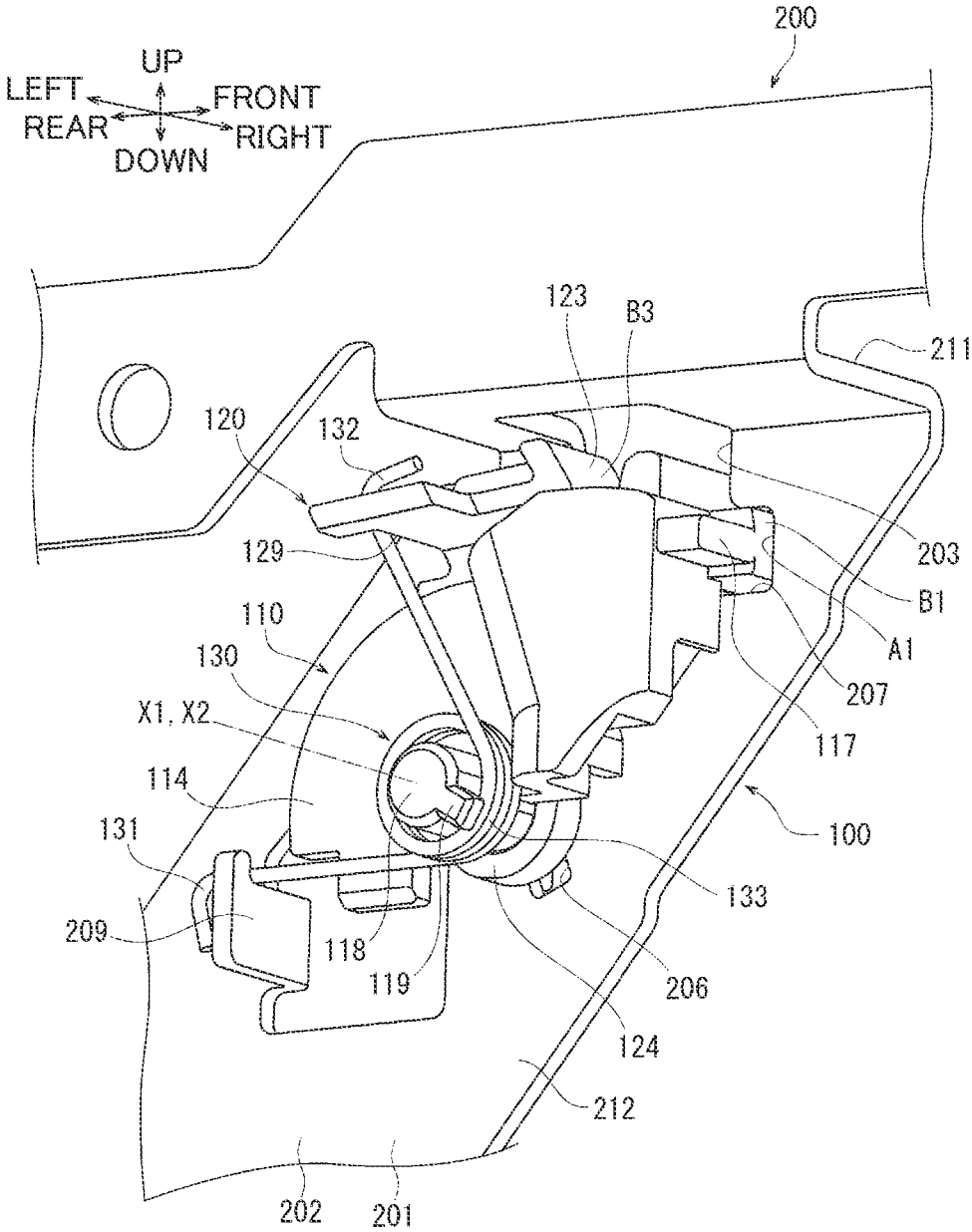
FIG. 6 shows a partial perspective view illustrating the frame and one regulating mechanism.
Figure 7:
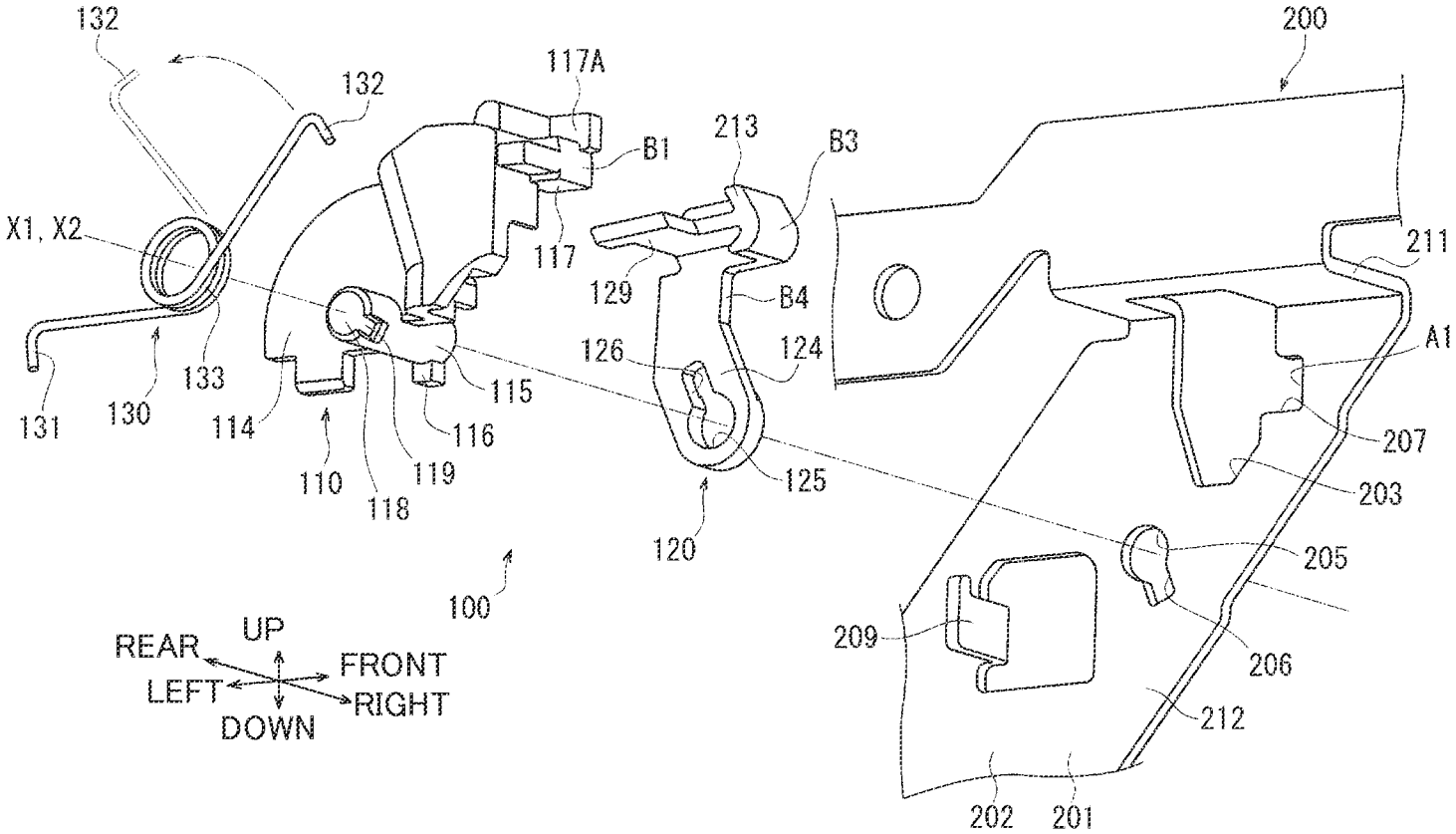
FIG. 7 shows an exploded perspective view illustrating the frame and one regulating mechanism.

The frame 200 has a first side surface 201 which is directed to the right side and which is opposed to the left end of the photosensitive drum 40 as shown in FIGS. 4 and 5, and a second side surface 202 which is directed to the side opposite to the first side surface 201, i.e., to the left side as shown in FIGS. 6 and 7. The frame 200 is formed with a horizontal wall portion 211 which has a part that is bent toward the right side, and a vertical wall portion 212 which hangs downwardly and backwardly from the right end edge of the horizontal wall portion 211.

As shown in FIGS. 4 to 7, the frame 200 has a cutout 203 which is open on the first side surface 201 and the second side surface 202. In particular, the cutout 203 is formed by cutting out the frame 200 toward the left side from the right end edge of the horizontal wall portion 211 and cutting out the frame 200 toward the lower side from the upper end edge of the vertical wall portion 212. Accordingly, as shown in FIGS. 4 and 5, the LED head for exposure 39, which is displaced in the upward-downward direction in accordance with the opening/closing of the upper surface cover 11, has the left end that is movable back and forth in the cutout 203.

As shown in FIGS. 6 and 7, a recess 207, which is cut out from an intermediate position in the upward-downward direction toward the front side, is formed at a portion of the cutout 203 cut out in the vertical wall portion 212. The bottom of the recess 207, i.e., the surface which extends in the upward-downward direction and which is directed to the back side defines a first contacting surface A1.

As shown in FIG. 7, the frame 200 is formed with a second shaft hole 205 and a second passing hole 206 which are open on the first side surface 201 and the second side surface 202. The second shaft hole 205 is a round hole which is positioned on the lower side from the cutout 203 and which is positioned on the back side. The axial center of the second shaft hole 205 constitutes a first swinging axial center X1 extending in the left-right direction. The second passing hole 206 is cut out to have a rectangular shape so that the second passing hole 206 extends in the radially outward direction of the second shaft hole 205 from the outer circumferential edge of the second shaft hole 205 on the vertical wall portion 212.

A first spring receiving portion 209, which is formed by bending an inner tab of a U-shaped slit toward the left side, is provided on the back side from the second shaft hole 205.

As shown in FIG. 5, the surface of the LED head for exposure 39 disposed at the approach position, which is directed to the back side and which is opposed in the front-back direction while providing a spacing distance with respect to the first contacting surface A1, defines a second contacting surface A2. Further, the surface of the LED head for exposure 39 disposed at the approach position, which is directed to the front side, i.e., the side opposite to the second contacting surface A2, defines a third contacting surface A3.

As shown in FIGS. 4 to 7, the regulating mechanism 100 has a fixing member 110 which is made of resin, a movable member 120 which is made of resin, and a torsion coil spring 130 which is formed by folding a metal wire material. The torsion coil spring 130 is an example of the "biasing member" of the present teaching.

Figure 8:
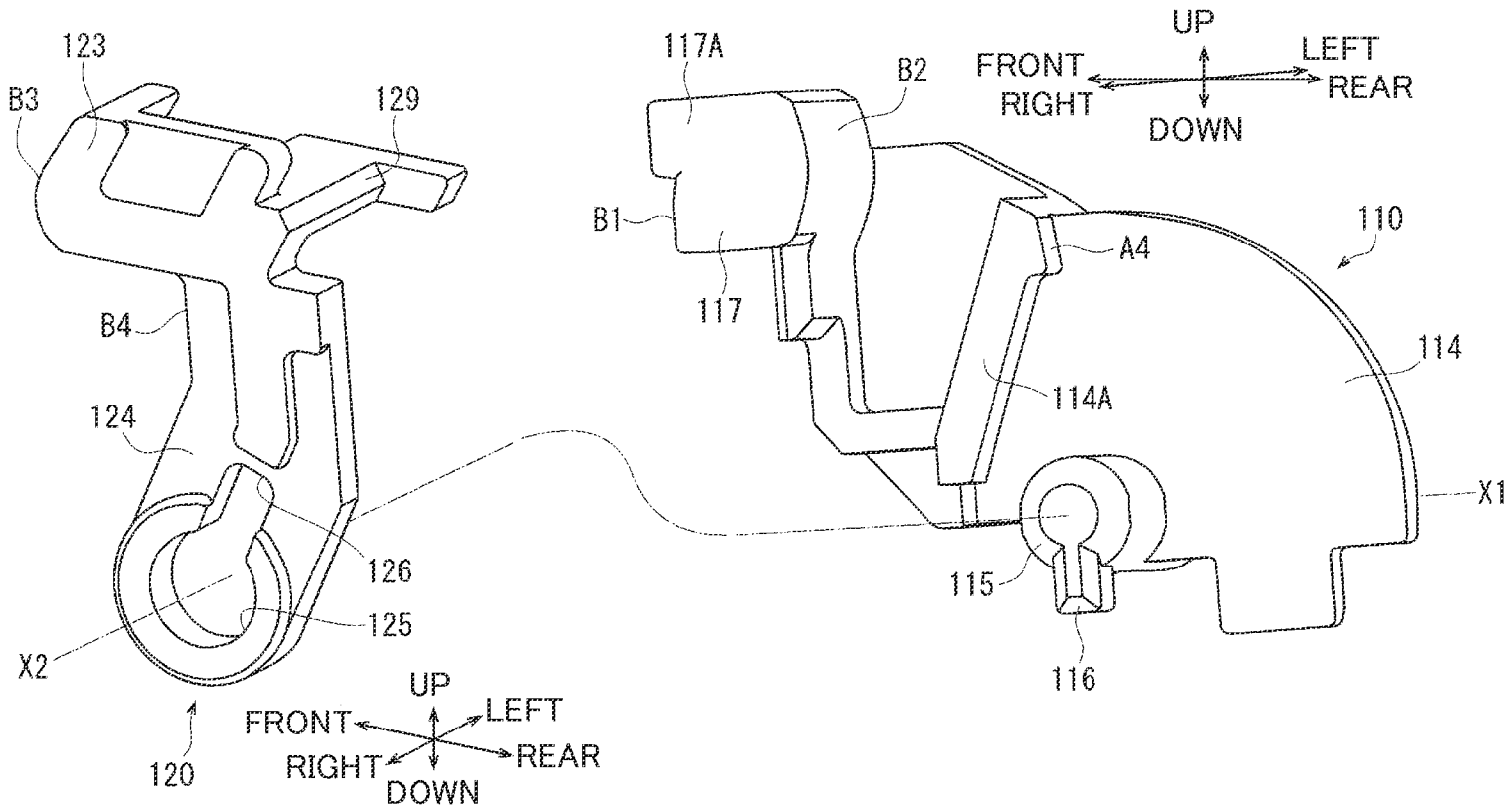
FIG. 8 shows a perspective view illustrating a fixing member and a movable member.

As shown in FIGS. 7 and 8, the fixing member 110 has a swinging shaft 115 which is a columnar shaft member extending in the direction of the first swinging axial center X1 and protruding rightwardly, and a fastening portion 116 which is a small tab protruding in a rectangular form in the radially outward direction of the swinging shaft 115 from the right end of the swinging shaft 115. The outer diameter of the swinging shaft 115 is formed to be slightly smaller than the inner diameter of the second shaft hole 205 of the frame 200. The fastening portion 116 is formed to be small to such an extent that the fastening portion 116 can pass through the second passing hole 206 of the frame 200.

The fixing member 110 has a sector portion 114 which has a sector shape provided about the center of the swinging shaft 115, and a protrusion 117 which protrudes in a block form frontwardly and rightwardly from the upper end of the sector portion 114. As shown in FIG. 8, a stepped portion 114A, which is expanded in a stepped form on the right side, is formed over or above the swinging shaft 115 on the right side surface of the sector portion 114. The surface of the stepped portion 114A, which is directed backwardly on the upper end side of the stepped portion 114A, forms a fourth contacting surface A4. As shown in FIGS. 6 and 7, the end surface of the protrusion 117, which is directed frontwardly, defines a first facing surface B1. As shown in FIG. 8, the end surface of the protrusion 117, which is directed backwardly, defines a second facing surface B2. As shown in FIGS. 7 and 8, the protrusion 117 is integrally formed with an auxiliary fastening portion 117A which is a small tab protruding upwardly and frontwardly in a continuous manner on the right side surface of the protrusion 117.

As shown in FIGS. 6 and 7, the fixing member 110 has a protruding portion 118 which is a columnar shaft member extending in the direction of the first swinging axial center X1 and protruding on the side opposite to the swinging shaft 115, i.e., on the left side, and a pawl 119 which is a small tab protruding in a rectangular form frontwardly and downwardly from the left end of the protruding portion 118.

As shown in FIGS. 7 and 8, the movable member 120 has a flat plate portion 124 which extends slenderly in a flat plate-shaped form in the upward-downward direction, and a first shaft hole 125 and a first passing hole 126 which are formed at the lower end of the flat plate portion 124. The first shaft hole 125 is a round hole which constitutes a second swinging axial center X2. The inner diameter of the first shaft hole 125 is formed to be slightly larger than the outer diameter of the swinging shaft 115. The first passing hole 126 is a small tab extending in a rectangular form from the outer circumferential edge of the first shaft hole 125 in the radially outward direction of the first shaft hole 125. The first passing hole 126 is formed to be large to such an extent that the fastening portion 116 of the fixing member 110 can pass therethrough.

The movable member 120 has a pressing portion 123 which protrudes in a block form frontwardly from the upper end side of the flat plate portion 124, and a second spring receiving portion 129 which protrudes leftwardly from the upper end side of the flat plate portion 124 and which is thereafter bent backwardly. The end surface of the pressing portion 123, which is directed frontwardly, defines a third facing surface B3. The end surface, which is directed frontwardly on the upper side of the flat plate portion 124, defines a fourth facing surface B4.

Figure 9:
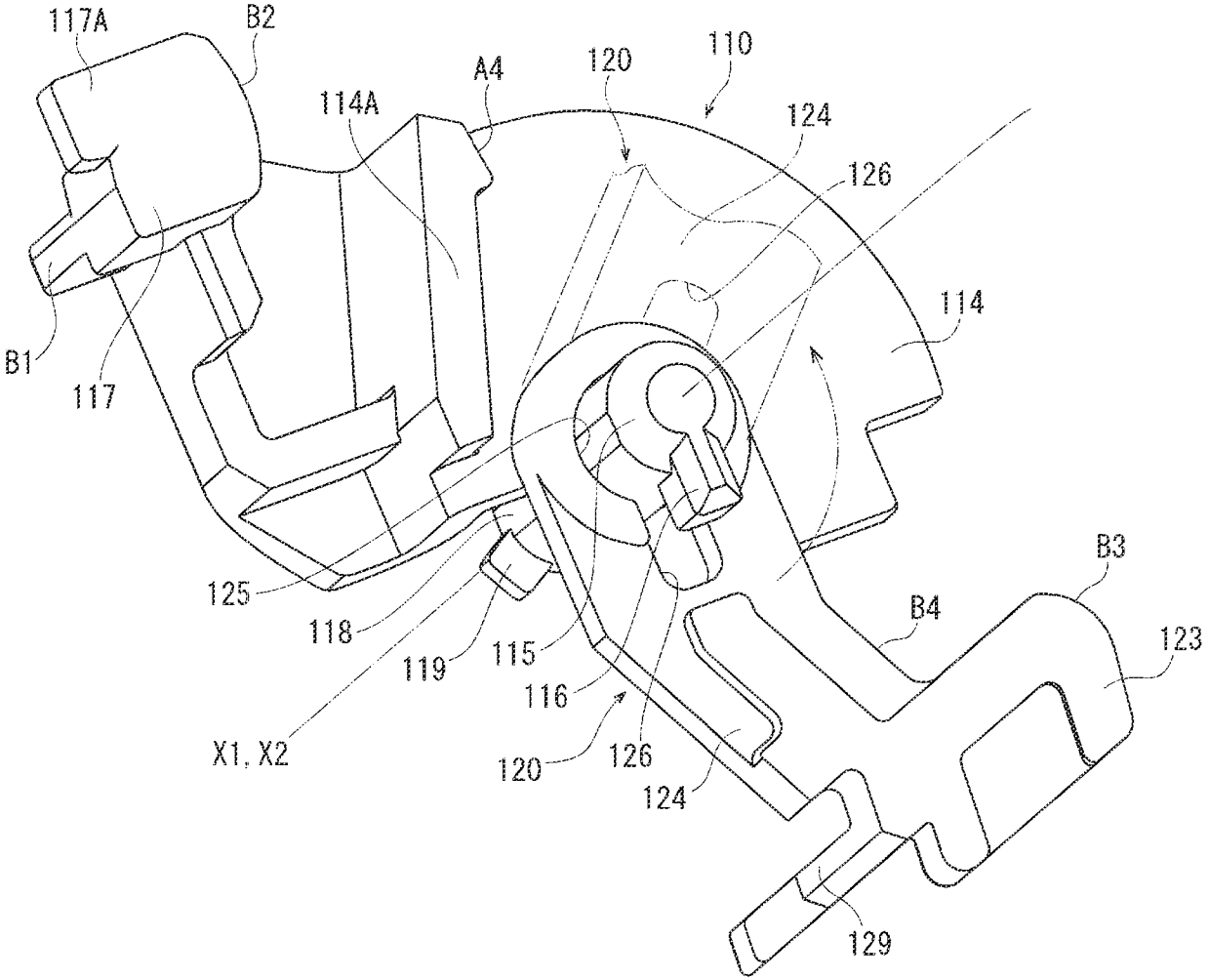
FIG. 9 shows a perspective view illustrating a procedure for attaching the movable member to the fixing member.

The movable member 120 is attached to the fixing member 110 as follows. That is, as shown in FIG. 9, the fastening portion 116 of the fixing member 110 is allowed to coincide with the first passing hole 126 of the movable member 120 as viewed in the direction of the first swinging axial center X1 so that the first swinging axial center X1 of the fixing member 110 and the second swinging axial center X2 of the movable member 120 are coaxial with each other. In this state, the swinging shaft 115 of the fixing member 110 is inserted into the first shaft hole 125 of the movable member 120, and the fastening portion 116 is allowed to pass through the first passing hole 126.

Subsequently, as shown by alternate long and two short dashes lines in FIG. 9, the movable member 120 is allowed to swing about the first swinging axial center X1 with respect to the fixing member 110 so that the fastening portion 116 and the first passing hole 126 are not coincident with each other as viewed in the direction of the first swinging axial center X1. As a result, the fastening portion 116 performs the regulation so that the swinging shaft 115 is not disengaged from the first shaft hole 125.

Figure 10:
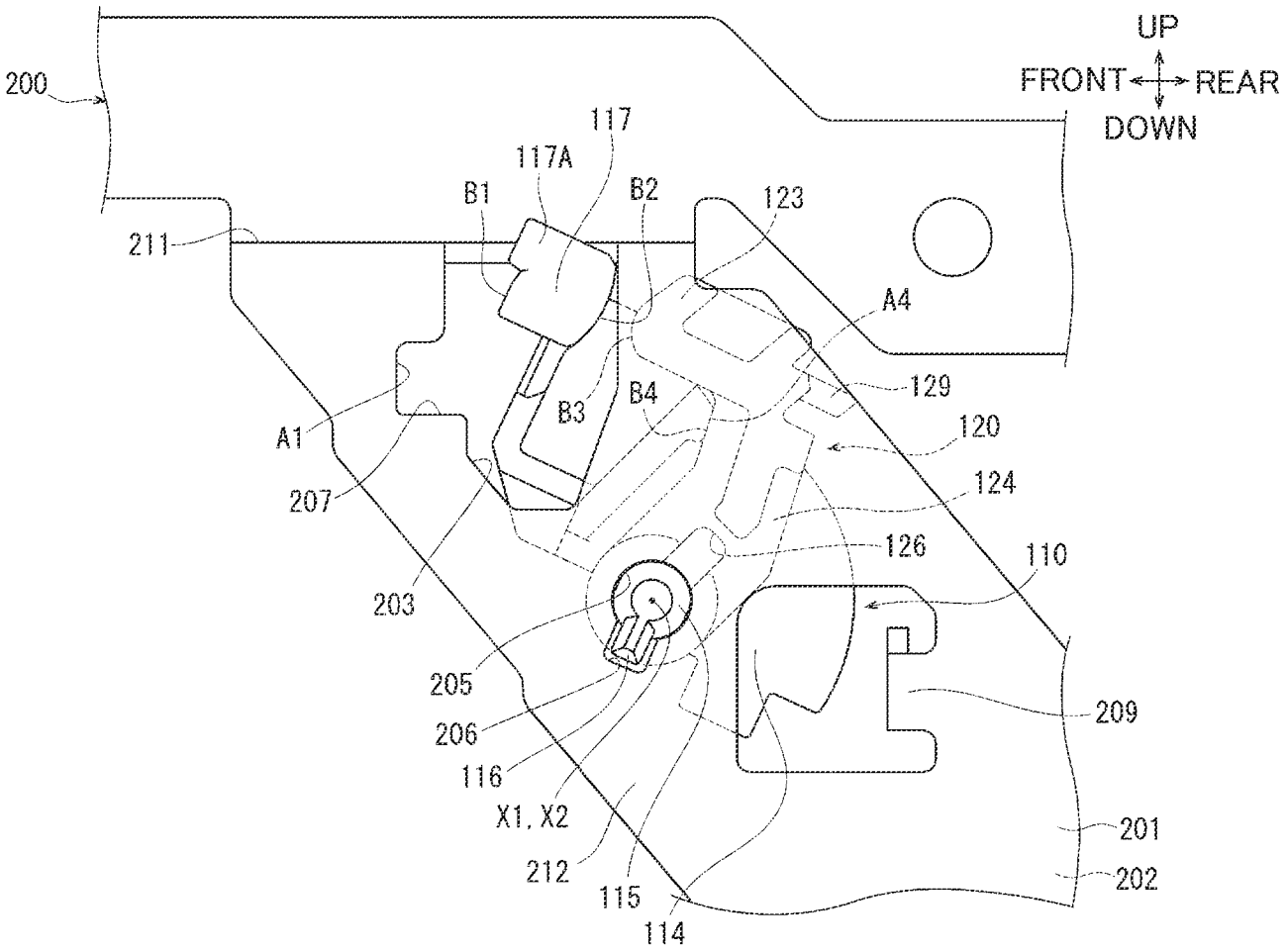
FIG. 10 shows a partial side view illustrating a procedure for attaching the fixing member to the frame.

The fixing member 110, to which the movable member 120 has been attached as described above, is attached to the frame 200 as follows. That is, as shown in FIG. 10, the fixing member 110, to which the movable member 120 has been attached, is positioned on the side of the second side surface 202 of the frame 200. The fastening portion 116 of the fixing member 110 is allowed to coincide with the passing hole 206 of the frame 200 as viewed in the direction of the first swinging axial center X1. In this state, the swinging shaft 115 of the fixing member 110 is inserted into the second shaft hole 205 of the frame 200, and the fastening portion 116 is allowed to pass through the second passing hole 206 to provide such a state that the right end of the swinging shaft 115 and the fastening portion 116 protrude on the side of the first side surface 201. Accordingly, the protrusion 117 enters the cutout 203, and the auxiliary fastening portion 117A passes through the cutout 203 to provide such a state that the auxiliary fastening portion 117A is positioned on the side of the first side surface 201.

Figure 11:
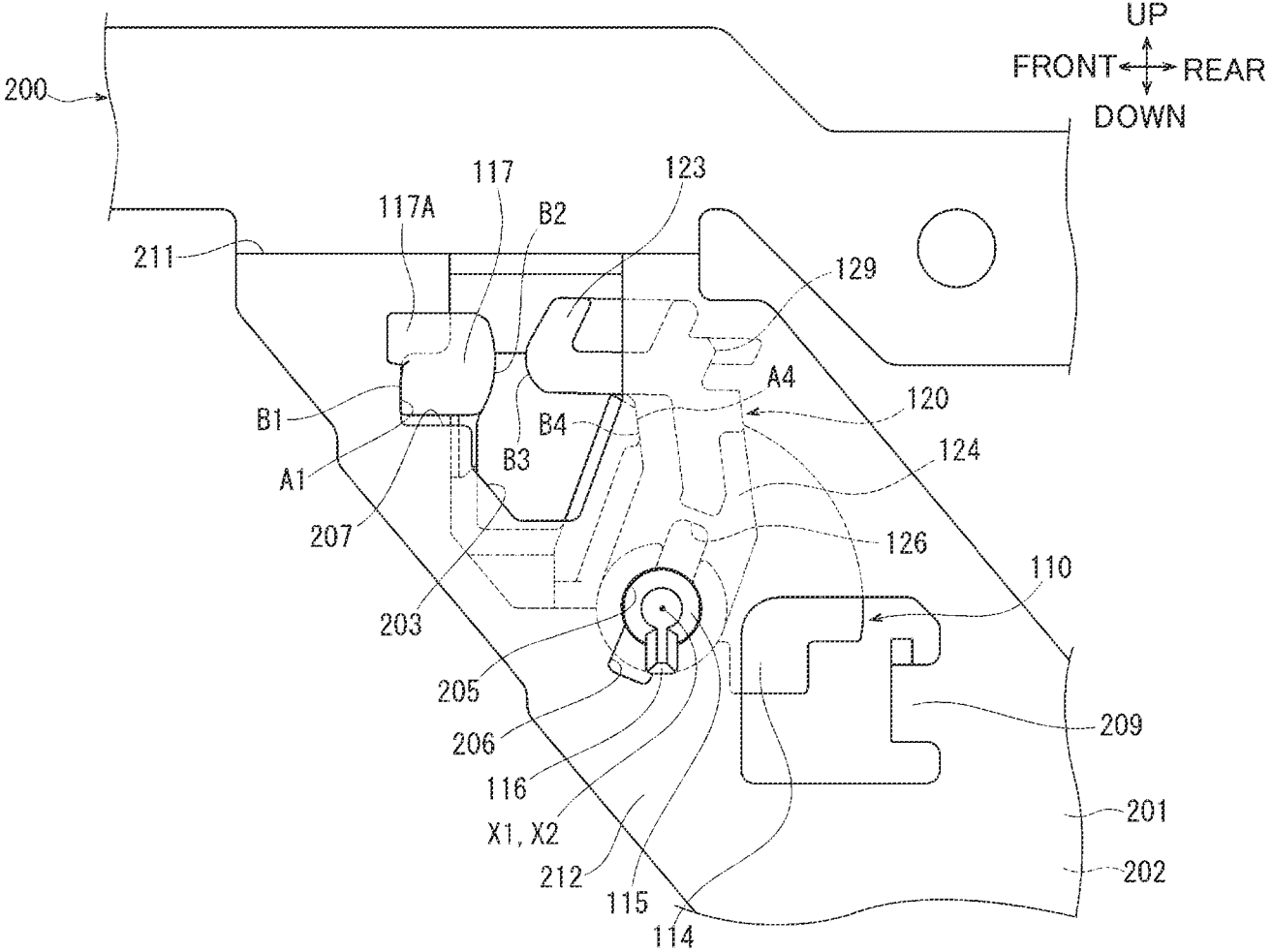
FIG. 11 shows a partial side view illustrating the fixing member and the movable member attached to the frame.
Figure 12:
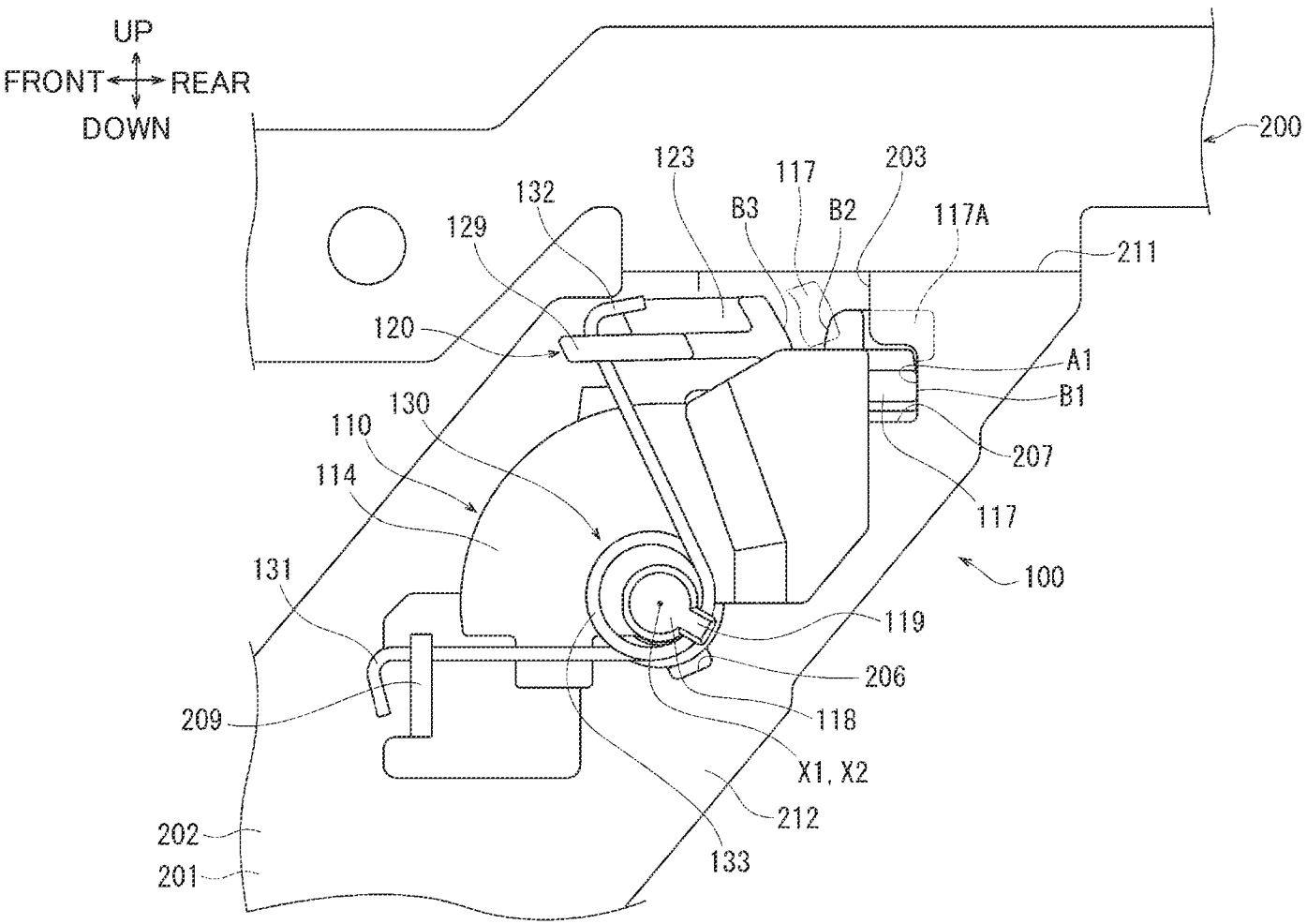
FIG. 12 shows a partial side view illustrating the fixing member and the movable member attached to the frame and an biasing member attached between the frame and the movable member.

Subsequently, the fixing member 110 is allowed to swing about the first swinging axial center X1 with respect to the frame 200. Specifically, the fixing member 110 is allowed to swing in the counterclockwise direction as viewed while confronting the paper surface of FIG. 10. Further, as shown in FIGS. 11 and 12, a state is given, in which the fastening portion 116 and the second passing hole 206 are not coincident with each other as viewed in the direction of the first swinging axial center X1, and the protrusion 117 is fitted into the recess 207. As a result, the fastening portion 116 performs the regulation so that the swinging shaft 115 is not disengaged from the first shaft hole 125. Therefore, as for the fixing member 110, the sector portion 114 and the protrusion 117 are positioned on the side of the second side surface 202, and the displacement in the left-right direction is regulated by the fastening portion 116 engaged on the side of the first side surface 201. Further, the movable member 120 is positioned on the side of the second side surface 202, and the movable member 120 is interposed by the frame 200 and the sector portion 114 of the fixing member 110.

In this arrangement, the relative positional relationship between the protrusion 117 and the recess 207 is set so that the connecting portion between the protrusion 117 and the sector portion 114 is elastically deformed during the process in which the protrusion 117 is fitted into the recess 207. Further, the setting is made to such an extent that the connecting portion between the protrusion 117 and the sector portion 114 is restored to the original state after the protrusion 117 is fitted into the recess 207, and a backlash is generated between the protrusion 117 and the recess 207. Accordingly, the swinging movement of the fixing member 110 about the first swinging axial center X1 with respect to the frame 200 is regulated.

During this process, the auxiliary fastening portion 117A makes a contact with the area of the vertical wall portion 212 disposed on the upper side from the recess 207, from the side of the first side surface 207. Accordingly, the protrusion 117 is prevented from being disengaged from the cutout 203 to the side of the second side surface 202.

As shown in FIGS. 11 and 12, in the state in which the fixing member 110 and the movable member 120 are attached to the frame 200, the fixing member 110 is supported by the frame 200 on the upper end side of the fixing member 110 swingably about the first swinging axial center X1, and the movable member 120 is supported by the fixing member 110 on the upper end side of the movable member 120 swingably about the second swinging axial center X2 which is coaxial with the first swinging axial center X1. Accordingly, the respective upper end sides of the fixing member 110 and the movable member 120 are displaceable in the front-back direction.

In this state, the first facing surface B1 of the fixing member 110 is opposed from the back side with respect to the first contacting surface A1 of the frame 200. Further, the fourth facing surface B4 of the movable member 120 is opposed from the back side with respect to the fourth contacting surface A4 of the fixing member 110.

As shown in FIGS. 6, 7, and 12, the torsion coil spring 130 has a coil portion 133 which is twisted in a coil form, and one end 131 and the other end 132 which extend in the mutually different directions from the coil portion 133.

As for the torsion coil spring 130, as shown in FIGS. 6 and 12, one end 131 is fastened by the first spring receiving portion 209 of the frame 200, and the other end 132 is fastened by the second spring receiving portion 129 of the movable member 120 in such a state that the biasing force is accumulated by allowing one end 131 and the other end 132 to approach to one another as shown by alternate long and two short dashes lines in FIG. 7. Further, the pawl 119 is engaged with the coil portion 133 in such a state that the protruding portion 118 is inserted into the coil portion 133 and the pawl 119 passes through the coil portion 133. Accordingly, the coil portion 133 is held by the fixing member 110. In this arrangement, in the state in which the fixing member 110 and the movable member 120 are attached to the frame 200, the pawl 119 protrudes in the direction in which the pawl 119 is separated from the first spring receiving portion 209 and the second spring receiving portion 129, from the left end of the protruding portion 118.

Figure 13:
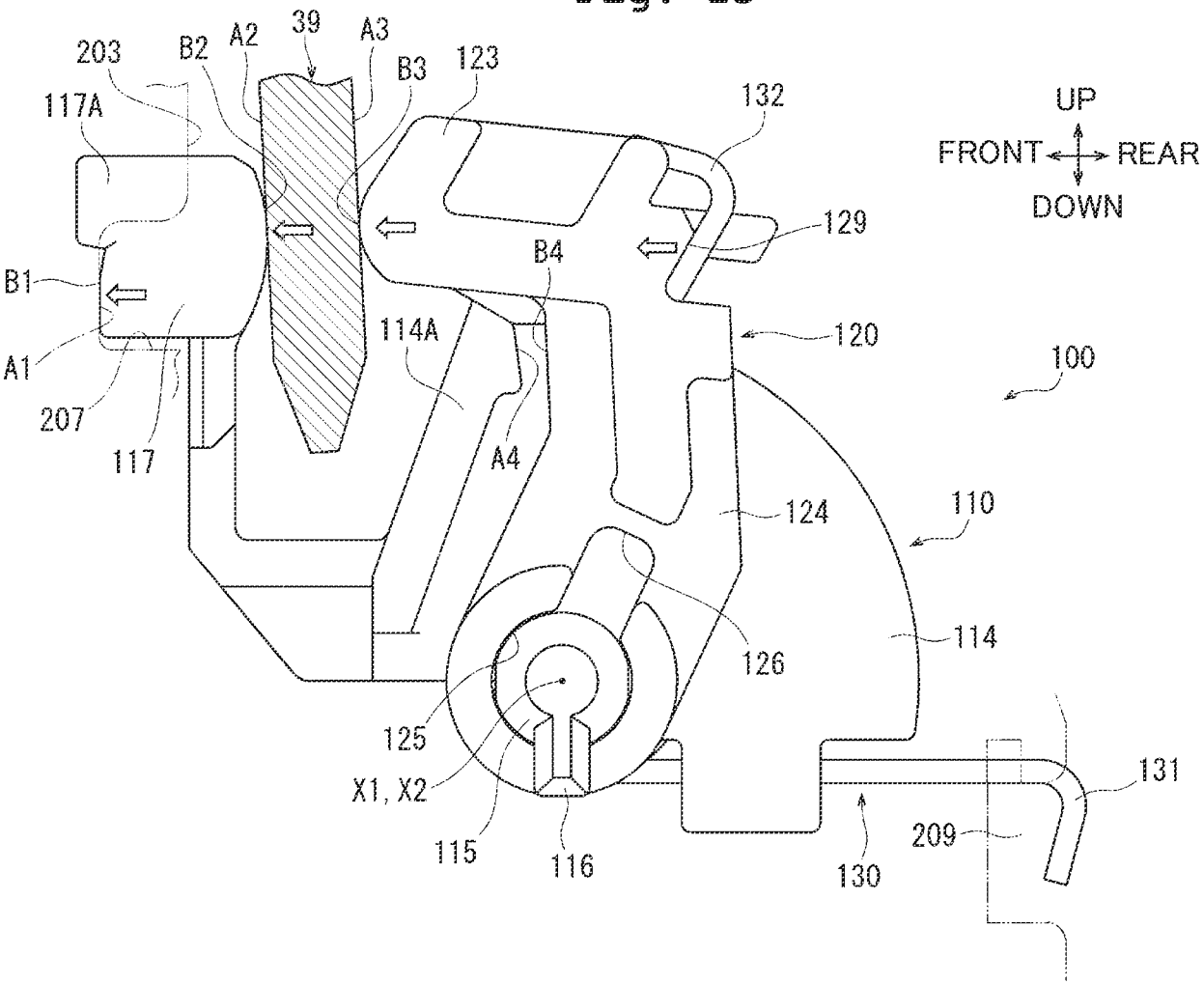
FIG. 13 illustrates the transmission route of the biasing force of the biasing member in a state in which the exposure mechanism is disposed at the approach position.
Figure 14:
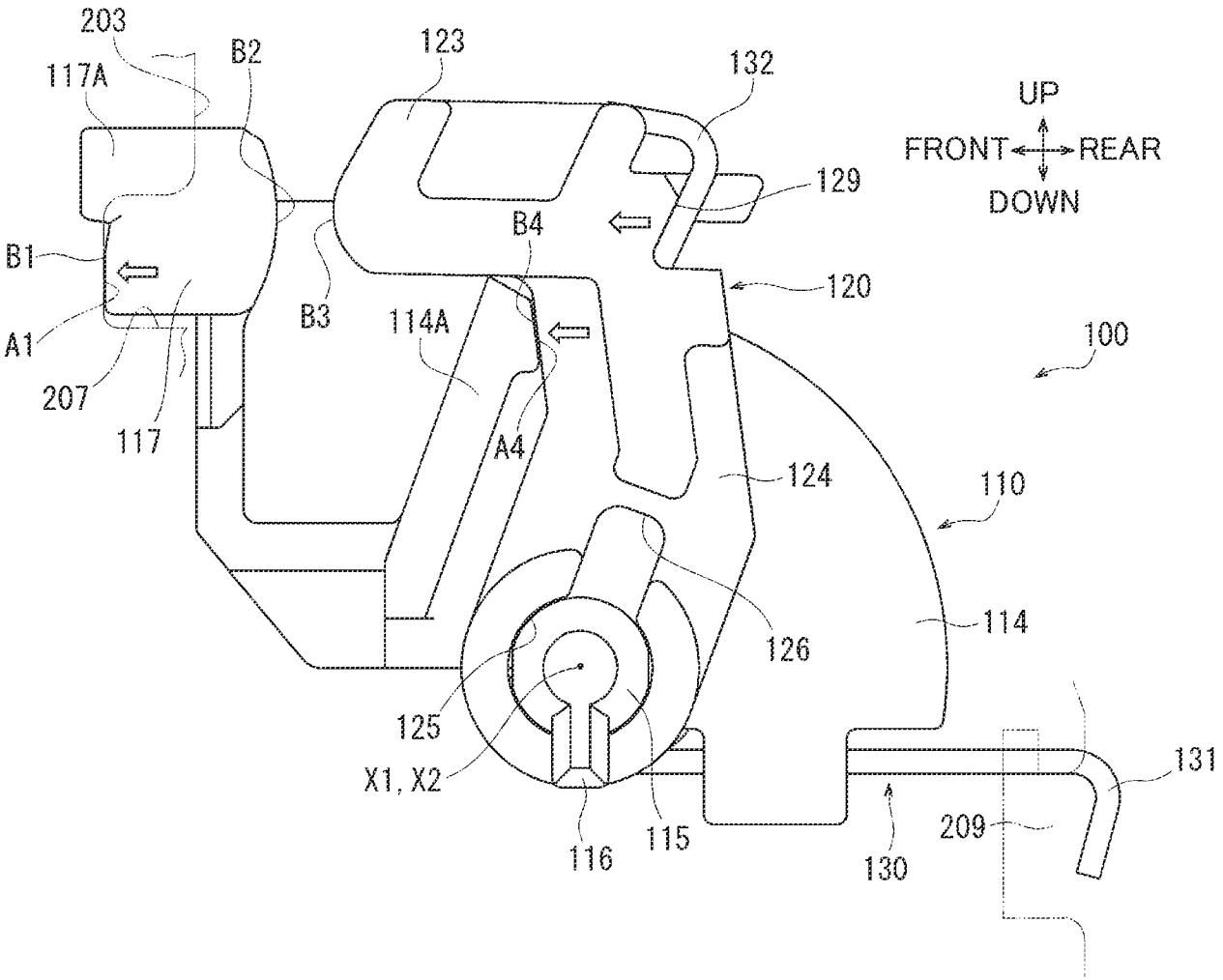
FIG. 14 illustrates the transmission route of the biasing force of the biasing member in a state in which the exposure mechanism is disposed at the separation position.

Thus, the torsion coil spring 130, which is provided between the frame 200 and the movable member 120, biases the pressing portion 123 of the movable member 120 frontwardly. In this arrangement, as shown in FIG. 13, when the LED head for exposure 39 is disposed at the approach position, the torsion coil spring 130 biases such that the third facing surface B3 is allowed to make a contact with the third contacting surface A3, the second facing surface B2 is allowed to make a contact with the second contacting surface A2, and the first facing surface B1 is allowed to make a contact with the first contacting surface A1. Further, as shown in FIG. 14, when the LED head for exposure 39 is disposed at the separation position, the torsion coil spring 130 has the biasing force such that the fourth facing surface 84 is allowed to make a contact with the fourth contacting surface A4 and the first facing surface B1 is allowed to make a contact with the first contacting surface A1. Blanked arrows shown in FIGS. 13 and 14 indicate the transmission routes of the biasing force of the torsion coil spring 130.

<Function and Effect>

In the image forming apparatus 1 of the embodiment, the regulating mechanism 100 positions the left end of the LED head for exposure 39 disposed at the approach position in the front-back direction as the positioning direction as follows.

That is, as shown in FIG. 13, when the LED head for exposure 39 is disposed at the approach position, then the biasing force of the torsion coil spring 130 is transmitted to the movable member 120 by the aid of the first spring receiving portion 129 of the movable member 120, and the pressing portion 123 of the movable member 120 is biased frontwardly. Accordingly, the third facing surface B3 of the pressing portion 123 makes a contact with the third contacting surface A3 of the LED head for exposure 39, and the LED head for exposure 39 is pushed frontwardly. Accordingly, the second facing surface B2, which is the surface of the protrusion 117 of the fixing member 110 directed backwardly, makes a contact with the second contacting surface A2 of the LED head for exposure 39, and the protrusion 117 is pushed frontwardly. Accordingly, the first facing surface B1, which is the surface of the protrusion 117 directed frontwardly, makes a contact with the first contacting surface A1 of the frame 200 and stops. In other words, when the LED head for exposure 39 is disposed at the approach position, the LED head for exposure 39, which is biased by the torsion coil spring 130 by the aid of the movable member 120, makes a contact with the frame 200 by the aid of the fixing member 110 and stops. Therefore, the LED head for exposure 39 is positioned with respect to the frame 200 together with the fixing member 110.

On the other hand, as shown in FIG. 14, when the LED head for exposure 39 is disposed at the separation position, then the biasing force of the torsion coil spring 130 is transmitted to the movable member 120 by the aid of the first spring receiving portion 129 of the movable member 120, and the flat plate portion 124 of the movable member 120 is biased frontwardly. Accordingly, the fourth facing surface B4, which is the surface of the flat plate portion 124 directed frontwardly, makes a contact with the fourth contacting surface A4 which is the surface of the stepped portion 114A of the fixing member 110 directed backwardly, and the protrusion 117 of the fixing member 110 is pushed frontwardly. Accordingly, the first facing surface B1, which is the surface of the protrusion 117 directed frontwardly, makes a contact with the first contacting surface A1 of the frame 200 and stops. In other words, when the LED head for exposure 39 is disposed at the separation position, the fixing member 110, which is biased by the torsion coil spring 130 by the aid of the movable member 120, makes a contact with the frame 200 and stops. Therefore, the fixing member 110 is positioned with respect to the frame 200.

Thus, the regulating mechanism 100 positions the LED head for exposure 39 in the front-back direction by means of the simple structure having the fixing member 110, the movable member 120, and the torsion coil spring 130. Further, the fixing member 110 is always positioned with respect to the frame 200 irrelevant to whether the LED head for exposure 39 is disposed at the approach position or the separation position. Therefore, in the case of this image forming apparatus 1, it is unnecessary to provide any joining mechanism such as any screw or the like for fixing the fixing member 110 to the frame 200. As a result, in the case of this image forming apparatus 1, it is possible to realize the reduction of the number of parts and the simplification of the assembling operation in relation to the regulating mechanism 100.

Therefore, the image forming apparatus 1 of the embodiment makes it possible to realize the inexpensive production cost. Further, in the case of this image forming apparatus 1, the number of parts of the regulating mechanism 100 is reduced as compared with the conventional image forming apparatus described above, and thus the installation space for the regulating mechanism 100 can be decreased. Therefore, it is possible to realize the small size.

In the case of this image forming apparatus 1, the fixing member 110 and the movable member 120 make the swinging movement about the first swinging axial center X1 and the second swinging axial center X2 which are coaxial with each other. Accordingly, in the image forming apparatus 1, it is possible to easily realize the arrangement in which the fixing member 110 is supported by the frame 200 displaceably in the front-back direction and the arrangement in which the movable member 120 is supported by the fixing member 110 displaceably in the front-back direction. Owing to the fact that the first swinging axial center X1 and the second swinging axial center X2 are coaxial with each other, the swinging shaft 115 can be commonly used for the fixing member 110 and the movable member 120. Therefore, it is possible to reliably realize the reduction of the number of parts.

Further, in the image forming apparatus 1, as for the fixing member 110, the fastening portion 116 is engaged on the side of the first side surface 201 of the frame 200, and the displacement in the left-right direction is regulated. The movable member 120 is positioned on the side of the second side surface 202, and the movable member 120 is interposed by the frame 200 and the sector portion 114 of the fixing member 110. Accordingly, the fixing member 110 also functions to prevent the movable member 120 from being disengaged in the left-right direction. Therefore, it is possible to reliably realize the reduction of the number of parts.

In the image forming apparatus 1, the fixing member 110 has the swinging shaft 115 and the fastening portion 116, the movable member 120 has the first shaft hole 125 and the first passing hole 126, and the movable member 120 is attached to the fixing member 110 in accordance with the procedure as described above. Therefore, it is possible to simplify the operation for attaching the movable member 120 to the fixing member 110. Further, both of the movable member 120 and the fixing member 110 can be attached to the frame 200. As a result, it is possible to further simplify the operation for assembling the regulating mechanism 100.

Further, in the image forming apparatus 1, the frame 200 has the second shaft hole 205, the second passing hole 206, and the recess 207, the fixing member 110 has the protrusion 117, the fixing member 110, to which the movable member 120 has been attached, is attached to the frame 200 in accordance with the procedure as described above, and the swinging movement is regulated about the first swinging axial center X1 with respect to the frame 200. Therefore, the fixing member 110 can be temporarily fixed to the frame 200 merely by allowing the fixing member 110 to swing about the first swinging axial center X1 with respect to the frame 200 and fitting the protrusion 117 into the recess 207. As a result, it is possible to further simplify the operation for assembling the regulating mechanism 100.

In the image forming apparatus 1, the pawl 119, which is to be engaged with the coil portion 133, protrudes in the direction in which the separation is effected with respect to the first spring receiving portion 209 and the second spring receiving portion 129 from the left end of the protruding portion 118. Therefore, even when the torsion coil spring 130 is bent and deformed, and the coil portion 133 is displaced in the radial direction of the protruding portion 118, then the coil portion 133 is hardly disengaged from the protruding portion 118 and the pawl 119.

Further, in the image forming apparatus 1, the regulating mechanism 100, which positions the left end of the LED head for exposure 39, is provided on the frame 200 which holds the left end side of the photosensitive drum 40. Therefore, it is possible to raise the positioning accuracy of the LED head for exposure 39 with respect to the photosensitive drum 40.

In the image forming apparatus 1, the frame 200 is made of metal, and the fixing member 110 and the movable member 120 are made of resin. When the frame 200 is made of metal, it is possible to raise the positioning accuracy of the LED head for exposure 39 with respect to the photosensitive drum 40. When the fixing member 110 and the movable member 120, which have the complicated shapes, are made of resin, it is possible to realize the inexpensive production cost.

The present teaching has been explained above in accordance with the embodiment. However, it goes without saying that the present teaching is not limited to the embodiment described above, and the present teaching can be applied while being appropriately changed within a range or scope without deviating from the gist or essential characteristics thereof.

The present teaching can be utilized, for example, for the image forming apparatus and the multifunction machine.

What is claimed is:

1. An image forming apparatus configured to form an image on a sheet comprising:

a main apparatus body;

a photoconductor which is held by the main apparatus body, which is configured to carry a toner image, and which is configured to transfer the toner image to the sheet transported in the main apparatus body;

an exposure mechanism supported by the main apparatus body displaceably to an approach position at which the exposure mechanism approaches the photoconductor and a separation position at which the exposure mechanism is separated from the photoconductor and which is configured so that a latent image is formed on the photoconductor at the approach position to allow the photoconductor to carry the toner image;

a frame which is provided on the main apparatus body so that the frame is positioned on one end side of the photoconductor in a widthwise direction thereof that is parallel to an axial center of the photoconductor; and a regulating mechanism which is provided on the frame and which is configured so that the exposure mechanism disposed at the approach position is positioned in a positioning direction which is perpendicular to the widthwise direction and which intersects an approaching/separating direction in which the exposure mechanism is displaced between the approach position and the separation position, wherein the regulating mechanism includes a fixing member which is supported by the frame displaceably in the positioning direction, a movable member which is supported by the fixing member displaceably in the positioning direction, and a biasing member which is provided between the frame and the movable member;

the frame includes a first contacting surface which is directed to one side in the positioning direction;

the exposure mechanism includes a second contacting surface which is directed to the other side in the positioning direction at the approach position, and a third contacting surface which is directed to one side in the positioning direction at the approach position;

the fixing member includes a fourth contacting surface which is directed to one side in the positioning direction, a first facing surface which faces the first contacting surface from one side in the positioning direction, and a second facing surface which faces the second contacting surface from the other side in the positioning direction under a condition that the exposure mechanism is disposed at the approach position;

the movable member includes a third facing surface which faces the third contacting surface from one side in the positioning direction under a condition that the exposure mechanism is disposed at the approach position, and a fourth facing surface which faces the fourth contacting surface from one side in the positioning direction under a condition that the exposure mechanism is disposed at the separation position; and the biasing member biases the movable member from one side in the positioning direction to the other side in the positioning direction, the biasing member including such a biasing force that the third facing surface is allowed to make a contact with the third contacting surface, the second facing surface is allowed to make a contact with the second contacting surface, and the first facing surface is allowed to make a contact with the first contacting surface under a condition that the exposure mechanism is disposed at the approach position, while the fourth facing surface is allowed to make a contact with the fourth contacting surface, and the first facing surface is allowed to make a contact with the first contacting surface under a condition that the exposure mechanism is disposed at the separation position.

2. The image forming apparatus according to claim 1, wherein the fixing member is configured such that one end side of the fixing member is supported by the frame swingably about a first swinging axial center parallel to the widthwise direction, and the other end side of the fixing member is displaceable in the positioning direction; and the movable member is configured such that one end side of the movable member is supported by the fixing member swingably about a second swinging axial center parallel to the widthwise direction, and the other end side of the movable member is displaceable in the positioning direction.

3. The image forming apparatus according to claim 2, wherein the frame includes a first side surface which faces the photoconductor in the widthwise direction and a second side surface which is directed oppositely to the first side surface, the frame being formed with a cutout which is configured such that the cutout is open on the first side surface and the second side surface and the exposure mechanism is movable back and forth therein in the approaching separating direction;

the fixing member is positioned on a side of the second side surface and the fixing member is configured so that the fixing member is engageable on a side of the first side surface to regulate displacement in the widthwise direction; and the movable member is positioned on the side of the second side surface and the movable member is interposed between the frame and the fixing member.

4. The image forming apparatus according to claim 3, wherein the first swinging axial center and the second swinging axial center are coaxial with each other.

5. The image forming apparatus according to claim 4, wherein the fixing member includes a swinging shaft which extends in a direction of the first swinging axial center to protrude on the side of the first side surface, and a fastening portion which protrudes in a radially outward direction of the swinging shaft from a forward end of the swinging shaft;

the movable member is formed with a first shaft hole into which the swinging shaft is inserted, and a first passing hole which extends from an outer circumferential edge of the first shaft hole in a radially outward direction of the first shaft hole and through which the fastening portion passes; and the movable member is attached to the fixing member by allowing the movable member to swing with respect to the fixing member about the first swinging axial center so that the fastening portion and the first passing hole are not coincident with each other as viewed in the direction of the first swinging axial center in a state in which the swinging shaft is inserted into the first shaft hole and the fastening portion has passed through the first passing hole.

6. The image forming apparatus according to claim 5, wherein the frame is formed with a second shaft hole which constitutes the first swinging axial center and through which the swinging shaft is allowed to pass, and a second passing hole which extends in a radially outward direction of the second shaft hole from an outer circumferential edge of the second shaft hole and through which the fastening portion is allowed to pass;

the fixing member includes a protrusion which protrudes while being directed from one side in the positioning direction to the other side in the positioning direction, a forward end of the protrusion defining the first facing surface;

the frame has a recess which is formed while being directed from one side in the positioning direction to the other side in the positioning direction, a bottom of the recess defining the first contacting surface; and the fixing member and the frame are configured such that the fixing member makes swinging movement about the first swinging axial center with respect to the frame so that the fastening portion and the second passing hole are not coincident with each other as viewed in the direction of the first swinging axial center and the protrusion is fitted into the recess in a state in which the swinging shaft of the fixing member attached with the movable member is inserted into the second shaft hole and the fastening portion is allowed to pass through the second passing hole, and thus the fixing member is attached to the frame and the swinging movement is regulated thereby about the first swinging axial center with respect to the frame.

7. The image forming apparatus according to claim 6, wherein the biasing member is a torsion coil spring;

one end of the torsion coil spring is fastened first spring receiving portion which is provided on the frame;

the other end of the torsion coil spring is fastened by a second spring receiving portion which is provided on the movable member;

a coil portion of the torsion coil spring, which is twisted in a coil-shaped form between one end and the other end, is held by the fixing member;

the fixing member has a protruding portion which extends in the direction of the first swinging axial center and which protrudes to make separation from the frame, and a pawl which protrudes from a forward end of the protruding portion in a direction to make separation from the first spring receiving portion and the second spring receiving portion; and the pawl is engaged with the coil portion in a state in which the protruding portion is inserted into the coil portion and the pawl has passed through the coil portion, and thus the coil portion is held by the fixing member.

8. The image forming apparatus according to claim 1, wherein the frame holds one end side in the widthwise direction of the photoconductor.

9. The image forming apparatus according to claim 1, wherein the frame is made of metal, and the fixing member is made of resin.

* * * * *

UNITED STATES PATENT AND TRADEMARK OFFICE

CERTIFICATE OF CORRECTION

PATENT NO. : 8,918,018 B2
APPLICATION NO. : 13/849827
DATED : December 23, 2014
INVENTOR(S) : Zhang Wei et al.

It is certified that error appears in the above-identified patent and that said Letters Patent is hereby corrected as shown below:

Claims

In Column 16, Claim 3, Line 64
Please delete "approaching separating" and insert --approaching/separating--

In Column 18, Claim 7, Line 19
Please delete "fastened first" and insert --fastened by a first--

Signed and Sealed this
Sixteenth Day of August, 2016

Michelle K. Lee

Michelle K. Lee
*Director of the United States Patent and Trademark Office*